United States Patent [19]

Charles et al.

[11] 4,037,987

[45] July 26, 1977

[54] FLEXIBLE BLADED FAN WITH INCREASED NATURAL FREQUENCY

[75] Inventors: Herbert N. Charles; George K. Lie, both of Chatham, Canada

[73] Assignee: Fram Corporation, East Providence, R.I.

[21] Appl. No.: 591,511

[22] Filed: June 30, 1975

[51] Int. Cl.[2] ..... F04D 29/36

[52] U.S. Cl. ..... 416/132 A; 416/240; 416/DIG. 3

[58] Field of Search ..... 416/132, 132 A, 240, 416/DIG. 3

[56] References Cited

U.S. PATENT DOCUMENTS

| | | | |
|---|---|---|---|
| 2,374,342 | 4/1945 | Gaubatz | 416/132 A |
| 3,044,557 | 7/1962 | Posh | 416/132 A |
| 3,406,760 | 10/1968 | Weir | 416/240 |
| 3,490,686 | 1/1970 | Weir | 416/132 A X |
| 3,594,098 | 7/1971 | Pratinidhi | 416/132 A |
| 3,664,165 | 5/1972 | Harvill et al. | 416/132 A X |
| 3,679,321 | 7/1972 | Strick | 416/132 A |
| 3,698,835 | 10/1972 | Kelly | 416/132 A |
| 3,773,435 | 11/1973 | Wooden | 416/132 A |
| 3,799,697 | 3/1974 | DeJong | 416/240 X |
| 3,827,826 | 8/1974 | Strick | 416/240 X |
| 3,891,349 | 6/1975 | Woollenweber | 416/132 |
| 3,910,718 | 10/1975 | MacEwen | 416/240 X |
| 3,914,069 | 10/1975 | Arrington et al. | 416/132 A |

*Primary Examiner*—Everette A. Powell, Jr.

[57] ABSTRACT

A flexible bladed fan comprising blade assemblies having a reinforcing member contacting each blade along the leading portion thereof, the blade and reinforcing member spaced apart at a gap behind the leading portion and contacting again at a second position behind the gap, the reinforcing member biasing the blade in a downstream direction at the second position.

5 Claims, 3 Drawing Figures

FLEXIBLE BLADED FAN WITH INCREASED NATURAL FREQUENCY

This invention relates to flexible bladed fans and especially to automotive fans having flexible blades which decamber in an upstream direction as fan rotational velocity increases.

A principal object of this invention is to increase the natural frequency of flexible fan blades and thereby to minimize resonance of the blades which may otherwise result from the torsional excitation from an internal combustion engine at typical idle speeds and which may lead to metal fatigue and premature blade failure.

In general, the invention features a fan comprising a hub and a plurality of fan blade assemblies. Each assembly comprises an arm radially extending from the hub, a flexible resilient blade connected along a radially extending leading portion to the arm and extending transversely therebehind to a trailing portion, the blade curved downstream behind the arm, and a reinforcing member extending radially along the leading portion of the blade and transversely to a position trailing the blade leading portion. The blade leading portion and the reinforcing member contact along the radial extent of the reinforcing member and are spaced apart at a gap behind the leading portion. The blade and the reinforcing member contact along the radial extent of the reinforcing member at a second position behind the blade leading portion and the gap. The reinforcing member at the second position biases the blade in a downstream direction.

Figure 1:
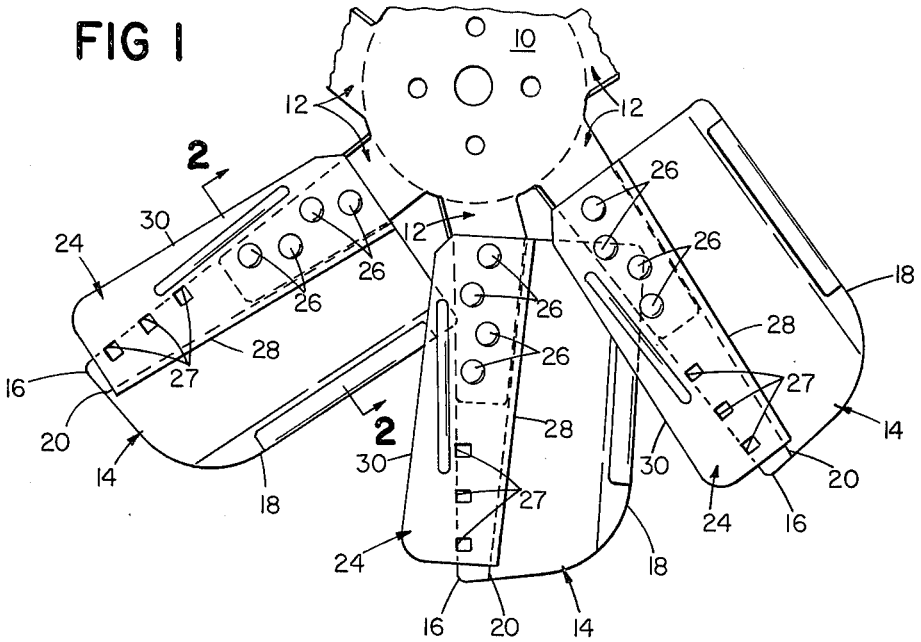
Figure 2:
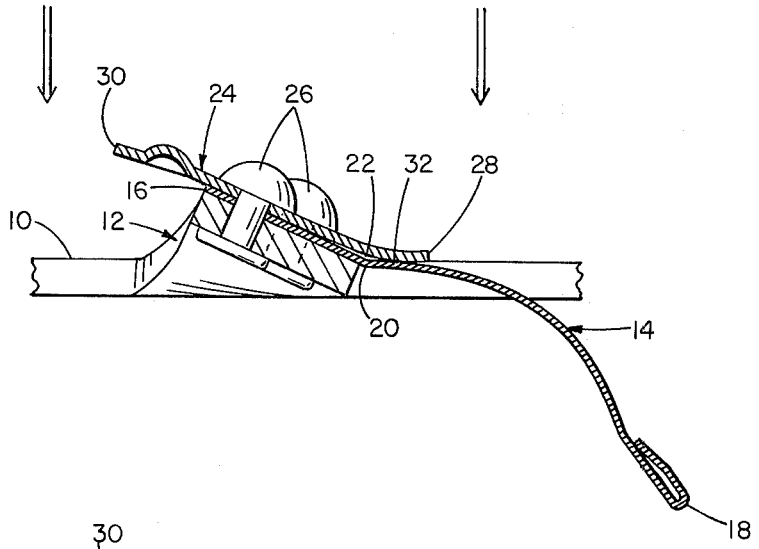
Figure 3:
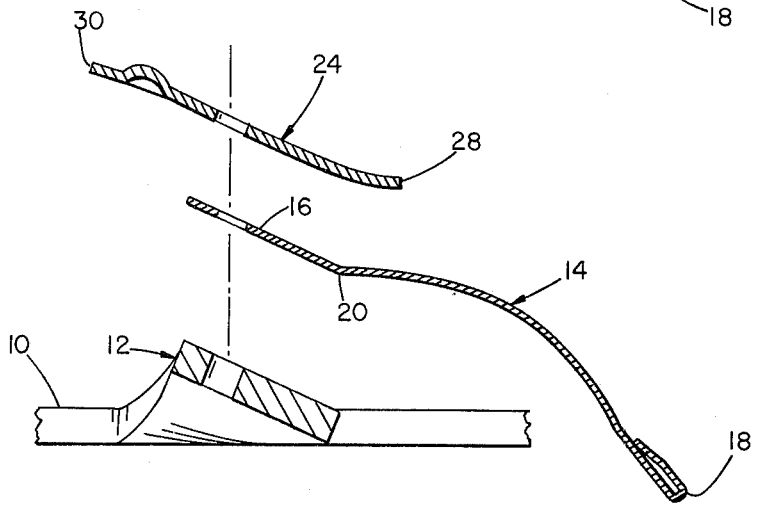

In a preferred embodiment the reinforcing member is curved in an upstream direction behind the blade leading portion. The blade is bent upstream between the leading portion thereof and the reinforcing member trailing edge, contacting the reinforcing member at the second position continuously along the radial extent of the member, and therebehind curved in a downstream direction. The second position is behind the arm and the blade is positioned on the upstream side of the arm. Other objects, features and advantages of this invention will be apparent to those skilled in the art from the following detailed description of a preferred embodiment thereof taken together with the accompanying drawings, in which:

FIG. 1 is a fragmentary plan view of a fan embodying the invention;

FIG. 2 is an enlarged sectional view taken along the line 2—2 of FIG. 1; and FIG. 3 is an exploded view of the principal components of the fan illustrated in FIG. 2. Referring to FIGS. 1 and 2 of the drawings, the fan includes a spider forming a hub 10 and arms 12 integral with and radially extending from the hub. The hub and arms are formed of rigid steel. The arms are twisted adjacent the hub to set the plane of the arms at an angle of 25° to the plane of the hub.

A blade 14 of flexible resilient material is positioned on the upstream side, relative to the direction of air flow indicated by arrows in FIG. 2, of each arm 12. Each blade 14 comprises a leading portion 16 extending radially along and beyond the arm 12. The blade 14 extends transversely from the leading portion 16 to a trailing edge 18 and is curved therebetween in a downstream direction. The trailing edge is preferably weighted as disclosed in U.S. Pat. No. 3,594,098.

A reinforcing member 24 is positioned on the upstream side of blade 14 sandwiching the blade against arm 12, the blade 14 and member 24 joined to arm 12 by rivets 26. The reinforcing member 24 extends radially substantially along the entire radial extent of blade 14 and, outwardly of arm 12, is preferably joined to the blade by tabs 27 as disclosed in U.S. Pat. No. 3,799,697. The reinforcing member 24 extends transversely to a trailing edge 28 behind the blade leading portion 16. Reinforcing member 24 is in contact with the blade leading portion 16 along the coextensive portions thereof. Behind the blade leading portion 16, reinforcing member 24 is curved upstream, separating and spaced from blade 14 at a gap 22 behind the blade leading portion 16.

In the illustrated preferred embodiment of FIG. 1, as also disclosed in U.S. Pat. No. 3,799,697, the reinforcing member 24 trailing edge 28 lies at an acute angle, i.e. 7°, to a radial line (not shown) extending along the forward rivets 26 securing member 24 and blade 14 to arm 12. The leading edge 30 of member 24, the line (not shown) along which the reinforcing member 24 separates from blade 14, the axis of curvature of member 24 and the axis of curvature of blade 14 are parallel to the trailing edge 28 of member 24. The trailing edge 18 of blade 14 extends at an angle of 5° to the said radial line.

Between the blade leading portion 16 and the reinforcing member trailing edge 28, the blade 14 is bent upstream along a line 20 parallel to the trailing edge 28 continuously contacting, with the fan stationary, the reinforcing member 24 along the coextensive portions thereof at a second position 32 behind arm 12, blade leading portion 16 and gap 22. The blade 14 curves downstream behind the second position 32. As best shown in FIG. 3, the angle to which the blade is bent along line 20 relative to the curvature of reinforcing member 24, results in downstream biasing of the blade, when assembled, by the reinforcing member 24 at the second position 32.

In operation, as the fan is rotated, especially at engine idle speed, the second contact position, in effect, shortens the length of the flexible portion of the blade 14. Together with the biasing force applied to the blade, the shortened free length of the blade makes it possible to increase the natural frequency of the blade, e.g., to about 48–50 Hz., relative to the natural frequency of a similar blade, e.g., 40–42 Hz., not incorporating the foregoing features. Raising the natural frequency of the blade to 48+ Hz. minimizes resonance resulting from the engine which typically has an input frequency below 48 Hz. The minimization of idle resonance enhances the fan durability without the use of shims and the like which undesirably add weight to fans.

Other embodiments of this invention will occur to those skilled in the art which are within the scope of the following claims.

What is claimed is:

1. In a fan comprising a hub and a plurality of fan blade assemblies each comprising: an arm extending radially outwardly from said hub; a flexible, resilient blade having a radially extending leading portion, defined by the direction of fan rotation, connected to said arm, said blade extending transversely from said leading portion to a trailing edge behind said arm, said blade curved from said leading portion to said trailing edge in a downstream direction relative to airflow direction; and a reinforcing member extending radially along said blade leading portion on the upstream side thereof and extending transversely to a trailing edge between said leading portion and said blade trailing edge; said blade leading portion and said reinforcing member in contact along the radial extent of said reinforcing member and spaced apart at a gap behind said leading portion; the improvement in which:

said blade and said reinforcing member, with said fan stationary, contact along the radial extent of said reinforcing member at a second position behind said leading portion and said gap, said reinforcing member being curved in an upstream direction behind said blade leading portion at said gap and said blade being bent upstream between said blade leading portion and said reinforcing member trailing edge and contacting said reinforcing member at said second position between said bend and said trailing edge and therebehind said blade being curved in said downstream direction, said reinforcing member at said second position biasing and pre-stressing said blade in a downstream direction; whereby the natural frequency of said blade is raised by the pre-stressing contact of said blade and said reinforcing member.

2. The improvement claimed in claim 1 in which said blade is positioned on the upstream side of said arm.

3. The improvement claimed in claim 1 in which said second position is behind said arm.

4. The improvement claimed in claim 3 in which said blade is positioned on the upstream side of said arm.

5. The improvement claimed in claim 4 in which said blade and said reinforcement member at said second position are in contact continuously along the radial extent of said reinforcement member.

* * * * *